United States Patent [19]

Kubo et al.

[11] Patent Number: 4,500,896

[45] Date of Patent: Feb. 19, 1985

[54] HEAT-SENSITIVE RECORDING MEDIUM AFFORDING PATTERNS WITH DIFFERENT COLORS

[75] Inventors: Keishi Kubo, Yokohama; Hideo Watanabe, Numazu; Nobuhiro Takigawa, Numazu; Minoru Hagiri, Numazu; Kanjiro Kawasaki, Numazu, all of Japan

[73] Assignee: Ricoh Company, Ltd., Tokyo, Japan

[21] Appl. No.: 573,357

[22] Filed: Jan. 24, 1984

[30] Foreign Application Priority Data

Jan. 25, 1983 [JP] Japan ..... 58-10388
Mar. 12, 1983 [JP] Japan ..... 58-40960

[51] Int. Cl.[3] ..... B41M 5/22

[52] U.S. Cl. ..... 346/204; 346/205; 346/207; 346/208; 346/226; 428/488.4; 428/913; 428/914

[58] Field of Search ..... 346/204, 205, 207, 208, 346/226; 428/488.1, 488.4, 913, 914

[56] References Cited

U.S. PATENT DOCUMENTS 4,328,977 5/1982 Ozawa et al. ..... 346/204

FOREIGN PATENT DOCUMENTS 3913 1/1980 Japan ..... 346/204
6117684 9/1981 Japan ..... 346/204
6157396 12/1981 Japan ..... 346/204

*Primary Examiner*—Bruce H. Hess
*Attorney, Agent, or Firm*—Flynn, Thiel, Boutell & Tanis

[57] ABSTRACT

A heat-sensitive recording medium including:

(a) a transferring sheet which includes
- a first substrate,
- a lower layer provided over the first substrate and comprised of a discoloring agent and a solid ink having a first color, and
- an upper layer provided above the lower layer and containing a leuco-compound capable of coloring in a second color which is different from the first color by reaction with a developer at such a first temperature that at least one of said leuco-compound and said developer can melt but that neither the discoloring agent nor the solid ink can melt, the leuco-compound being incapable of coloring upon contact with the developer in the presence of the discoloring agent at such a second temperature that both of the discoloring agent and the solid ink can melt; and (b) a receiving sheet which includes
- a second substrate, and
- a developing layer provided over the second substrate and containing the developer. When the recording medium is subjected to thermal recording temperatures with the upper layer being maintained in thermal contact with the developing layer, there are formed a first image developed by the contact between the leuco-compound and the developer at the first temperature and a second, fused image of the solid ink at the second temperature, the first and second images being received by the receiving sheet.

16 Claims, 5 Drawing Figures

HEAT-SENSITIVE RECORDING MEDIUM AFFORDING PATTERNS WITH DIFFERENT COLORS

BACKGROUND OF THE INVENTION

This invention relates generally to an image transfer-type, heat-sensitive recording medium. More particularly, the present invention is concerned with a two component type, heat-sensitive recording medium composed of, as a first component, a transferring sheet and, as a second component, a receiving sheet and capable of affording patterns with different colors when subjected to thermal recording conditions at different temperatures while maintaining the both sheets in contact with each other.

An image transfer-type, heat-sensitive recording material is of a type in which, when heat is applied to the recording material by means of, for example, a thermal stylus while maintaining the recording material in contact with a receiving sheet, a fused image formed on the recording material is transferred to the receiving sheet. As the heat-sensitive materials are applied in a variety of fields, there is an increasing demand for image transfer-type, heat-sensitive recording materials capable of affording two or more different colors and there are known several such recording materials in the art. For example, Japanese published unexamined patent application No. 57-150600 suggests the incorporation of a heat-sensitive ink which colors at a higher temperature into a layer of a solid ink provided over a substrate, the solid ink being capable of melting or subliming at a lower temperature. When the recording material is heated at a first temperature sufficient for the solid ink to melt but insufficient for the heat-sensitive ink to color, while maintaining the recording material in contact with a receiving sheet, a first image of the solid ink is transferred to the receiving sheet. Upon heating the recording material at a second temperature sufficient for the coloration of the heat-sensitive ink, there is developed a second image which is different from the first image and which is transferred to the receiving sheet. Although the first image obtained at the first temperature is excellent in both color tone and sharpness, the second image unavoidably has a mixed tone due to the simultaneous fusion of the solid ink and is not well-defined.

SUMMARY OF THE INVENTION

It is, therefore, an object of the present invention to provide an image transfer-type, heat-sensitive recording medium affording patterns with different colors, especially two different colors, upon being subjected to different thermal recording temperatures, especially two different temperatures.

It is a more specific object of the present invention to provide a recording medium of the abovementioned type, in which each of the different colors of the recorded patterns has a single tone.

It is a further object of the present invention to provide a recording medium of the above-mentioned type capable of affording a clear, well defined, multicolored letters or patterns.

It is yet a further object of the present invention to provide a recording medium of the above-mentioned type which is free from undesirable smudge resulting from premature coloring and which may give patterns with a high image density even after storage for a long period of time.

In accomplishing the aforegoing objects, there is provided in accordance with the present invention a heat-sensitive recording medium which comprises a transferring sheet and a receiving sheet. The transferring sheet includes a first substrate, a lower layer provided over the first substrate and comprised of a discoloring agent and a solid ink having a first color, and an upper layer provided above the lower layer and containing a leuco-compound capable of coloring in a second color which is different from the first color by reaction with a developer at such a first temperature that at least one of the leuco-compound and the developer can melt but that neither the discoloring agent nor the solid ink can melt. The leuco-compound is, however, incapable of coloring upon contact with the developer in the presence of the discoloring agent at such a second temperature that both of the discoloring agent and the solid ink can melt. The receiving sheet includes a second substrate, and a developing layer provided over the second substrate and containing the developer. As a consequence of the above construction, when the recording medium is subjected to thermal recording temperatures while maintaining the upper layer of the transferring sheet in thermal contact with the developing layer of the receiving sheet, a first image is developed by the contact between the leuco-compound and the developer at the first temperature. At the second temperature, there is formed a second, fused image of the solid ink. The first and second images are received by the receiving sheet.

The lower layer may be either a single layer of the solid ink having dispersed therein the discoloring agent or a composite layer composed of a first layer of the solid ink coated over the first substrate and overlaid with a second layer of the discoloring agent. Preferably, a fusible protecting layer is provided between the lower and upper layers of the transferring sheet so that the contact of the leuco-compound with the discoloring agent during non-printing stage, such as during storage, is prevented.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE INVENTION

Figure 1:
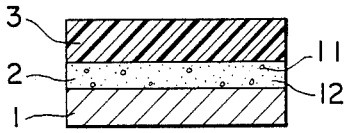
FIG. 1 is a cross-sectional view diagrammatically showing one embodiment of transferring sheet according to the present invention.

FIG. 1 depicts one preferred embodiment of a transferring sheet which is one of the two components of the heat-sensitive recording medium according to the present invention, in which reference numeral 1 denotes a first substrate on which a lower layer 2 containing a discoloring agent 11 and a solid ink 12 with a first color and an upper layer 3 containing a leuco-compound are formed. The lower layer 2 in this embodiment is a single layer of the solid ink 12 in which the discoloring agent 11 is substantially homogeneously dispersed.

Figure 2:
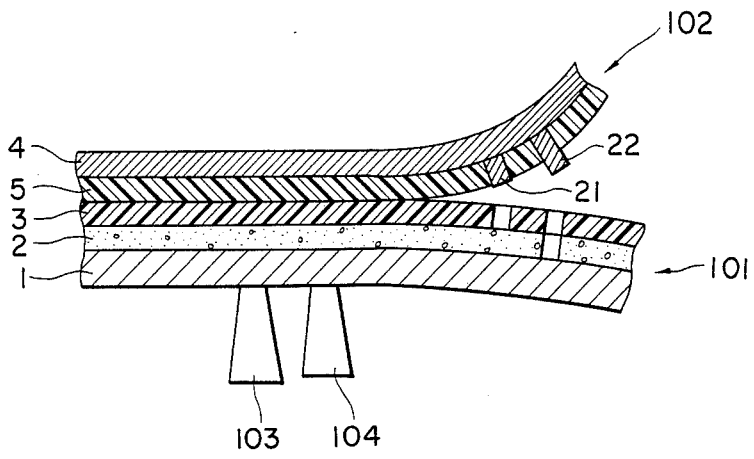
FIG. 2 is an illustration, in cross-section, schematically showing the thermal recording with the use of the heat-sensitive recording medium of the present invention wherein the transferring and receiving sheets are disposed in a face to face fashion.

The leuco-compound is capable of coloring in a second color different from the first color of the solid ink upon contact with a developer. In the presence of the discoloring agent, however, the contact of the leuco-compound and the developer fails to form a colored mark or image. A receiving sheet which is the other component of the recording medium of this invention is illustrated in FIG. 2. Designated as 4 is a second substrate over which a developing layer 5 containing the above-mentioned developer is provided. The receiving sheet is able to adsorb a fused image of the solid ink.

With continued reference to FIG. 2, the transferring sheet 101 and the receiving sheet 102 are, in a thermal recording stage, so positioned that the upper layer 3 of the transferring sheet 101 is maintained in thermal contact with the developing layer 5 of the receiving sheet 102 and are heated from the backside of the transferring sheet 101 or the receiving sheet 102 by customarily employed means 103 and 104 such as a thermal head, a thermal printer or a thermal stylus.

The thermal recording means 103 and 104 are adapted to heat the recording medium disposed adjacent thereto to a first and second temperature, respectively. At the first temperature, at least one of the lecuo-compound contained in the upper layer 3 and the developer contained in the developing layer 5 can melt for contact with each other but neither the discoloring agent nor the solid ink contained in the lower layer 2 can melt. At the second temperature, both of the discoloring agent and the solid ink contained in the lower layer can melt.

Thus, when the heat-sensitive recording medium is subjected to the above thermal recording conditions, the leuco-compound is transferred to the developing layer 5 for contact with the developer at the first temperature to form a colored image 21 having the second color on the receiving sheet 102. When heated to the second temperature by the recording means 104, the solid ink of the lower layer 2 melts to form a second, fused image 22 which is transferred to and adsorbed by the receiving sheet 102. In this case, the contact between the leuco-compound and the developer also occurs but fails to develop a colored image because of the action of the fused discoloring agent which inhibits the coloring reaction therebetween. As a result, the patterns obtained with the use of the recording medium of this invention do not have a mixed color even at the higher, second recording temperature and, hence, are sharp and free of blurs.

The second temperature is higher than the first temperature preferably by at least 20° C., more preferably by 20°-50° C. The first temperature is preferably between 60° and 100° C., more preferably between 65° and 80° C., while the second temperature is preferably between 80° and 150° C., more preferably between 90° and 120° C.

Any known solid ink may be used for the purpose of the present invention. The solid ink generally contains a fusible substance and a coloring agent dispersed in the fusible substance and has a higher melting point than the above-mentioned first temperature. Illustrative of suitable fusible substances are waxes such as carnauba waxes, montan waxes, paraffin waxes, microcrystalline waxes, polyethylene waxes, beeswaxes and mixtures thereof; and polymeric substances such as polyvinyl chlorides, polyvinyl acetates, vinyl chloride/vinyl acetate copolymers, polyethylenes, polypropylenes, polyacetals, ethylene/vinyl acetate copolymers, polystyrenes, low molecular weight polystyrenes, polyacrylates, polyamides, ethyl cellulose, epoxy resins, xylene resins, ketone resins, petroleum resins, rosins or derivatives thereof, coumarone-indene resins, terpene resins, polyurethane resins, styrene/butadiene rubbers, polyvinylbutylals, nitrile rubbers, acrylic rubbers, ethylene/-polypropylene rubbers.

Both fusible and infusible coloring agents may be used for the dispersion into the fusible substance. Examples of the coloring agent include black pigments such as carbon black, tri-iron tetroxide and Nigrosine Base, blue pigments such as Cyanine Blue, Oil Blue and Alkali Blue, and other pigments such as Iozol Red, Rose Bengal, Crystal Violet Lactone (colored type) and Brilliant Green. The melting points of the fusible coloring agents should be higher than the above-mentioned first temperature.

The solid ink may further contain one or more customarily used dispersing agents, for example, fats such as animal oils, vegetable oils, mineral oils, dioctyl phthalate, tricresyl phosphate, dibutyl phthalate and lanoline; extender pigments such as calcium carbonate, magnesium carbonate, diatomaceous earth, kaoline, white carbon and finely divided silicic acid; and nonionic surfactants such as dipolyoxyethylene alkyl ether phosphates, tripolyoxyethylene alkyl ether phosphates, polyoxyethylenestearylamines, polyoxyethyleneoleylamines, polyoxyethylene lauryl ethers, polyoxyethylene cetyl ethers and polyoxyethylene stearyl ethers. Typical example of the formulation of the solid ink is shown below.

| Composition | Amount (weight %) |
|---|---|
| Pigment | 10-20 |
| Wax | 0-50 |
| Fusible substance | 10-30 |
| Fat | 0-25 |
| Extender pigment | 0-25 |
| Dispersing agent | 0-2 |

If necessary, the solid ink may further contain an organic solvent such as toluene, methyl ethyl ketone, methyl isobutyl ketone, cyclohexane, n-butyl n-butyrate, dioxane or ethylbenzene. Preferably, the solid ink has a melting point of between 85° and 150° C., more preferably between 90° and 120° C. It is also preferred that the solid ink can melt sharply within a narrow range of temperature. The amount of the solid ink applied onto the first substrate is preferably between 1 and 10 g, more preferably between 2 and 4 g per square meter of the substrate.

The discoloring agent which forms the lower layer together with the solid ink is of a type which can inhibit the coloring reaction between the leuco-compound of the transferring sheet and the developer of the receiving sheet. Illustrative of suitable discoloring agents are alcohols such as stearyl alcohol, polypropylene glycols, pentamethylglycerin and dimethylpentaglycerin (disclosed in Japanese Examined Patent Publication No. 50-17865); polyethers and polyethylene glycol derivatives such as polyethylene oxide, polyoxydecamethylenes, trimethylene oxide, polyoxyethylene oleyl ethers, polyoxyethylene cetyl ethers, polyethylene glycol monostearates (disclosed in Japanese Examined Patent Publication No. 50-17866); addition products of bisphenols with an alkylene oxide such as a product obtained by reacting 1 mol of Bisphenol A with 2.6 mols of ethylene oxide and a product obtained by reacting 1 mol of Bisphenol A with 6.0 mols of ethylene oxide and 4.5 mols of propylene oxide (disclosed in Japanese Published Unexamined Patent Application No. 54-139741); and addition products of terephthalic acid with ethylene oxide such as a product obtained by reacting 1 mol of terephthalic acid with 2 mols of ethylene oxide.

Figure 3:
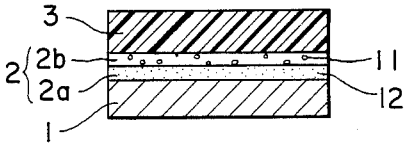
FIGS. 3 through 5 are cross-sectional views, similar to FIG. 1, showing alternate embodiments of the transferring sheet of the present invention.

The lower layer 2 of the transferring sheet shown in FIG. 1 is a single layer of the solid ink in which the discoloring agent is dispersed. In an alternative, as illustrated in FIG. 3, the lower layer may be composed of a composite layer having a first layer 2*a* formed of the solid ink 12 and provided over the substrate 1 and a second layer 2*b* formed of the discoloring agent 11. In this case, the discoloring agent may be also incorporated into the first layer 2*a*, if desired.

The discoloring agent is used in an amount sufficient to prevent the occurrence of the coloring reaction of the leuco-compound with the developer and preferably in an amount of between 0.5 and 50 parts by weight, more preferably between 1 and 3 parts by weight per part by weight of the leuco-compound contained in the upper layer 3.

Any leuco-compounds conventionally employed in the field of heat-sensitive or pressure-sensitive recording materials may be used for the purpose of the present invention. The leuco-compound may be of a triphenylmethane-series fluorane-series, phenothiazine-series, auramine-series, spiropyrane-series, etc. Illustrative of suitable leuco-compounds are 3,3-bis(4-dimethylaminophenyl)phthalide, 3,3-bis(4-dimethylaminophenyl)-6-dimethylaminophthalide (or Crystal Violet Lactone), 3-(N,N-dimethylamino)-5-methyl-7-(N,N-dibenzylamino)fluorane, 3,3-bis(4-dimethylaminophenyl)-6-diethyl-aminophthalide, 3,3-bis(4-dimethylaminophenyl)-6-chlorophthalide, 3,3-bis(4-dibutylaminophenyl)phthalide, 3-cyclohexylamino-6-chlorofluorane, 3-dimethylamino-5,7-dimethylfluorane, 3-diethylamino-7-chlorofluorane, 3-diethylamino-7-methylfluorane, 3-diethylamino-7,8-benzfluorane, 3-diethylamino-6-methyl-7-chlorofluorane, 3-(N-p-tolyl-N-ethylamino)-6-methyl-7-anilinofluorane, 3-pyrrolidino-6-methyl-7-anilinofluorane, 2-{N-(3'-trifluoromethylphenyl)amino}-6-diethylaminofluorane, 2-{3,6-bis(diethylamino)-9-(2-chloroanilino)xanthyl benzoic acid lactone}, 3-diethylamino-6-methyl-7-(m-trichloromethylanilino)fluorane, 3-diethylamino-7-(o-chloroanilino)fluorane, 3-butylamino-7-(o-chloroanilino)fluorane, 3-N-methyl-N-amylamino-6-methyl-7-anilinofluroane, 3-N-methyl-N-cyclohexylamino-6-methyl-7-anilinofluorane, 3-diethylamino-6-methyl-7-anilinofluorane, 3-(N,N-diethylamino)-5-methyl-7-(N,N-dibenzylamino)fluorane, benzoyl-leuco-methylene blue, 6'-chloro-8'-methoxybenzoindolino-pyrylospirane, 6'-bromo-3'-methoxy-benzoindolino-pyrylospirane, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylamino-phenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-morpholino-7-(N-propyl-N-trifluoromethylanilino)fluorane, 3-pyrrolidino-7-trifluoromethylanilinofluorane, 3-diethylamino-5-chloro-7-(N-benzyl-N-trifluoromethylanilino)fluorane, 3-pyrrolidino-7-(di-p-chlorophenylmethylamino)fluorane, 3-diethylamino-5-chloro-7-(α-phenylmethylamino)fluorane, 3-(N-ethyl-N-p-toluidino)-7-(α-phenylethylamino)fluorane, 3-diethylamino-7-(o-methoxycarbonylphenylamino)-fluorane, 3-diethylamino-5-methyl-7-(α-phenylethylamino)fluorane, 3-diethylamino-7-piperidinofluorane, 2-chloro-3-(N-methyltoluidino)-7-(p-n-butylanilino)fluorane, 3-(N-benzyl-N-cyclohexylamino-5,6-benzo-7-α-naphthylamino-4'-bromofluorane, 3-diethylamino-6-methyl-7-mesidino-4',5'-benzofluorane, etc.

The amount of the leuco-compound-containing upper layer in the transferring sheet is preferably between 0.5 and 5 g/m$^2$, more preferably between 1 and 3 g/m$^2$.

The receiving sheet of the heat-sensitive recording medium of the present invention includes a developing layer provided over a substrate and containing a developer which is an electron accepting substance such as a phenol, an organic acid, an ester or salt of the organic acid. The developer preferably has a melting point of 200° C. or below. Illustrative of suitable developers are as follows, in which the figures in the parentheses mean their melting points: 4-tert-butylphenol(98), 4-hydroxydiphenyl ether (84), 1-naphthol (98), 2-naphthol (121), methyl-4-hydroxybenzoate (131), 4-hydroxyacetophenone (109), 2,2'-dihydroxydiphenyl ether (79), 4-phenylphenol (166), 4-tert-octylcatechol (109), 2,2'-dihydroxydiphenyl (103), 4,4'-methylenediphenol (160), 2,2'-methylenebis(4-chlorophenol) (164), 2,2'-methylenebis(4-methyl-6-tert-butylphenol) (125), 4,4'-isopropylidenediphenol (156), 4,4'-isopropylidenebis(2-chlorophenol) (90), 4,4'-isopropylidenebis(2,6-dibromophenol) (172), 4,4'-isopropylidenebis(2-tert-butylphenol) (110), 4,4'-isopropylidenebis(2-methylphenol) (136), 4,4'-isopropylidenebis(2,6-dimethylphenol) (168), 4,4'-sec-butylidenediphenol (119), 4,4'-sec-butylidenebis(2-methylphenol) (142), 4,4'-cyclohexylidenediphenol (180), 4,4'-cyclohexylidenebis(2-methylphenol) (184), salicylic acid (163), m-tolyl salicylate (74), phenacyl salicylate (110), methyl 4-hydroxybenzoate (131), ethyl 4-hydroxybenzoate (116), propyl 4-hydroxybenzoate (98), isopropyl 4-hydroxybenzoate (86), butyl 4-hydroxybenzoate (71), isoamyl 4-hydroxybenzoate (50), phenyl 4-hydroxybenzoate (178), benzyl 4-hydroxybenzoate (111), cyclohexyl 4-hydroxybenzoate (119), 5-hydroxysalicilic acid (200), 5-chlorosalicilic acid (172), 3-chlorosalicilic acid (178), thiosalicilic acid (164), 2-chloro-5-nitrobenzoic acid (165), 4-methoxyphenol (53), 2-hydroxybenzyl alcohol (87), 2,5-dimethylphenol (75), benzoic acid (122), o-toluic acid (107), m-toluic acid (111), p-toluic acid (181), o-chlorobenzoic acid (142), m-hydroxybenzoic acid (200), 2,4-dihydroxyacetophenone (97), resorcinol monobenzoate (135), 4-hydroxybenzophenone (133), 2,4-dihydroxybenzophenone (144), 2-naphthoic acid (184), 1-hydroxy-2-naphthoic acid (195), ethyl 3,4-dihydroxybenzoate (128), phenyl 3,4-dihydroxybenzoate (189), 4-hydroxypropiophenone (150), salicylsalicylic acid (148), monobenzyl phthalate (107) and phenolic compounds represented by the general formula (I):

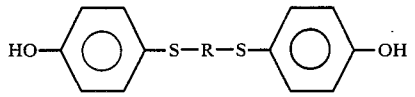

(I)

wherein R stands for an alkylene group having 1 to 5 ether linkages. The compound of the formula (I) may be obtained by reacting monothiohydroquinone with a dihalogenoalkyl ether in an alkaline medium. The ether linkage or linkages of the substituent R of the formula (I) may be present in the main chain and/or side chain of the alkylene group. The alkylene group has generally has 2–15 carbon atoms and has preferably 1–3 ether linkages and 2–7 carbon atoms. Examples of suitable phenolic compound of the formula (I) include:

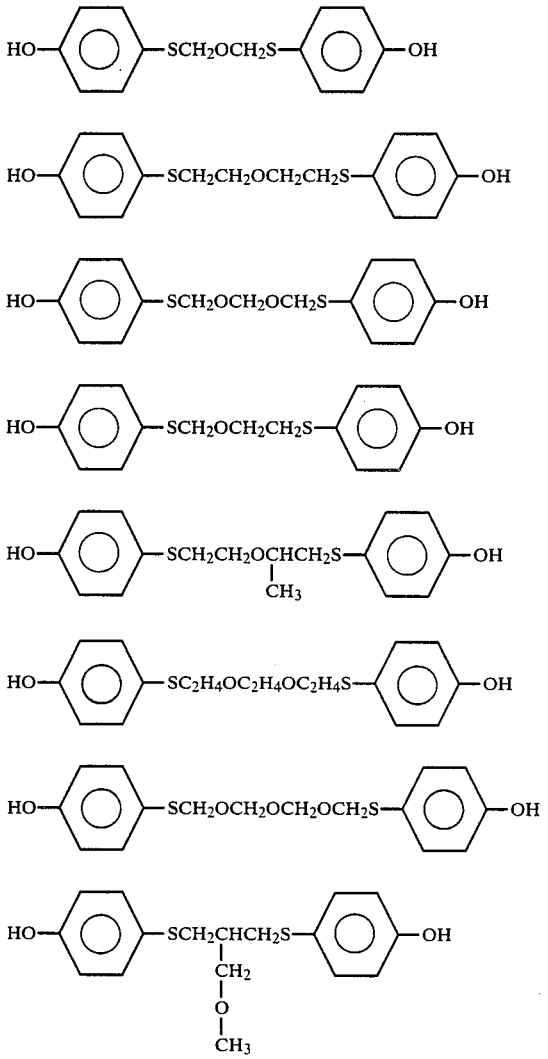

The amount of the developing layer of the receiving sheet is preferably in the range of between 0.3 and 30 g/m$^2$, more preferably between 1 and 10 g/m$^2$. The amount of the developer in the developing layer is preferably in the range of 2 and 15 parts by weight, more preferably between 3 and 7 parts by weight per part by weight of the leuco-compound supported on the transferring sheet. The substrate of the transferring or receiving sheet may be formed of a paper, synthetic paper, film of a synthetic polymeric material.

It is preferable to incorporate into the upper layer of the transferring sheet and/or the developing layer of the receiving sheet a porous filler having an oil absorbing capacity (speculated in Japanese Industrial Standards K 5101) of at least 50 ml/100 g, more preferably at least 150 ml/100 g for the purpose of improving the transferability or mobility of the reactant or reactants at the above-described first temperature and for forming on the receiving sheet a colored image of the leuco-compound with an optimum image density. The filler is incorporated into the developing layer in an amount of at least 0.01 part by weight, preferably between 0.05 and 10 parts by weight, more preferably between 0.1 and 3 parts by weight per part by weight of the developer. In the case of the upper layer, the filler is used in an amount preferably between 0.01 and 1 part by weight, more preferably between 0.03 and 0.5 parts by weight per part by weight of the leuco-compound. Illustrative of suitable fillers are silica, aluminum silicate, alumina, aluminum hydroxide, magnesium hydroxide, urea-formalin resins and styrene resins. The organic or inorganic fillers are suitably used in the form of a fine particulate.

It is preferred that the upper layer and/or the developing layer contain a fusible material capable of lowering the melting point of the leuco-compound and/or the developer for reasons of acceleration of the fluid contact, i.e. the heat-induced reaction therebetween. The fusible material preferably has a melting point of 200° C. or less, more preferably 150° C. or less. Illustrative of suitable fusible materials are amides such as lauramide, capramide, stearamide, behenamide, N-methylstearamide, N-cyclohexylstearamide, N-octadecylbenzamide and N-octadeylacetamide, and esters such as phenyl 4-hydroxybenzoate, 2'-methoxyphenyl 4-hydroxybenzoate, 2'-methoxyphenyl salicilate, 4'-benzylphenyl benzoate, 4'-methoxyphenyl benzoate, methyl 4-benzoyloxybenzoate and phenyl 4-benzoyloxybenzoate. If desired, the lower layer of the transferring sheet, too, may contain the above-described filler and/or fusible material.

The upper layer of the transferring sheet and/or the developing layer of the receiving sheet may further contain a conventionally employed binder which is soluble in water or in an organic solvent, or which is able to form an aqueous emulsion. Illustrative of suitable binders are polyvinyl alcohol, methoxycellulose, hydroxyethylcellulose, carboxymethylcellulose, polyvinylpyrrolidone, polyacrylamide, polyacrylic acid, starch, gelain, polystyrene, a vinyl chloride-vinyl acetate copolymer and polybutylmethacrylate. Resins having a softening or melting points of between 50° and 130° C. are particularly suited as binders for the upper layer of the transferring sheet. Examples of such resins include polyethylenes, polypropylenes, polystyrenes, petroleum resins, acrylic resins, polyvinyl chloride resins, polyvinyl acetate resins, polyvinylidene chloride resins, polyvinyl alcohols, cellulose resins, polyamides, polyacetals, polycarbonates, polyesters, fluorine resins, silicon resins, natural rubbers, butadiene rubbers, olefin rubbers, phenol resins, urea resins, melamine resins, epoxy resins and polyimides. These resins may be used by themselves or as copolymers or mixtures thereof. It is particularly preferable to use resins having a SP value, indicative of the solubility parameter thereof, of at least 8, more preferably at least 9. The SP value is defined by the following equation:

$$SP\ Value\ [(cal/cc)^{\frac{1}{2}}]=(E/V)^{\frac{1}{2}}$$

where E stands for the cohesion energy density (cal/mol) of the resin and V stands for the molar volume (cc/mol) of the resin.

It is preferable to provide a protecting layer between the upper and lower layers of the transferring sheet. The protecting layer should be pervious to the discoloring agent at the above-mentioned second temperature and preferably has a melting point of not higher than 150° C. The protecting layer may be formed of natural or synthetic waxes or various resins such as carnauba waxes, montan waxes, paraffin waxes, microcrystalline waxes, polyethylene waxes, beeswaxes, ionomer resins, ethylene/vinyl chloride copolymers, ethylene/vinyl acetate copolymers, ethylene/vinyl acetate/vinyl chloride graft copolymers, vinylidene chloride resins, vinyl chloride resins, chlorinated vinyl chloride resins, chlorinated polyethylenes, chlorinated polypropylenes, vinyl acetate and polyvinyl acetate resins, phenoxy resins, butadiene resins, fluorine resins, polyacetal resins, polyamide resins polyimide resins, polyethylene resins, polycarbonate resins, polystyrene resins, polysulfone resins, polyphenylenesulfide resins, polybutylene terephthalate resins, polypropylene resins, methacryl resins, guanamine resins, diallyphthalate resins, vinyl ester resins, phenol resins, unsaturated polyester resins, furan resins, aromatic polyether resins, polyurethane resins, melamine resins and urea resins.

Figure 4:
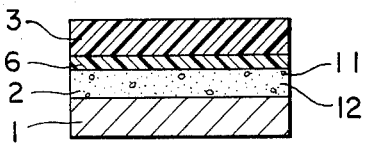
Figure 5:
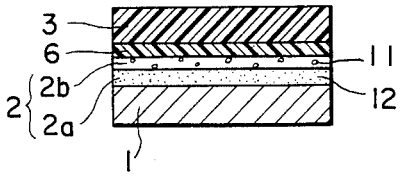

FIGS. 4 and 5 illustrate embodiments of the transferring sheet having the above-mentioned protecting layer. FIG. 4 shows an embodiment in which a protecting layer 6 is provided in the transferring sheet of FIG. 1, whereas FIG. 5 shows an embodiment in which the transferring sheet of FIG. 3 is further provided with a protecting layer 6. In FIGS. 4 and 5, similar components are designated by the same reference numerals.

The protecting layer 6 serves to prevent solid-solid contact between the leuco-compound contained in the upper layer 3 and the discoloring agent contained in the lower layer 2 during non-recording stage. Therefore, premature deterioration of the ability of the leuco-compound to color during storage can be advantageously prevented. Thus, notwithstanding the employment of the discoloring agent, the heat-sensitive medium according to the present invention is free from the reduction of its color developing property. Additionally, the protecting layer, if fusible at the first temperature, can also serve to accelerate the contact between the leuco-compound and the developer because the actual melting points of the leuco-compound and the developer are lowered in the presence of the molten protecting layer.

The heat-sensitive recording medium according to the present invention may be prepared by a method known per se. For example, the transfer sheet may be prepared by applying coatings of the lower layer- and upper layer-coating compositions onto a film of a synthetic polymeric material such as a polyester film by a hot-melt method, a solvent coating method or the like method.

The following examples will further illustrate the present invention, in which "part" and "%" mean "part by weight" and "weight %", respectively, unless otherwise noted specifically.

EXAMPLE 1

| Solid ink composition | |
|---|---|
| Carbon black | 20 parts |
| Carbauna wax | 10 parts |
| Paraffin wax (m.p. 97° C.) | 25 parts |
| Ethylene/vinyl acetate copolymer | 3 parts |
| Vaseline | 5 parts |
| Kaoline | 5 parts |

The composition having the above formulation was kneaded at 100° C. for 1 hour by means of a kneader with three rolls to obtain a fused ink. The ink was then coated onto a condenser paper (basis weight 15 g/m$^2$) by way of a hot-melt coating method and allowed to be cooled to form 3 g/m$^2$ of a coating of the solid ink.

| Discoloring agent-containing composition | |
|---|---|
| Addition product of Bisphenol A with ethylene oxide (average amount of the ethylene oxide incorporated into the Bisphenol A was 2.6 mols) | 15 parts |
| Polyvinyl alcohol (15% aqueous solution) | 30 parts |
| Water | 55 parts |

The discoloring agent-containing composition with the above formulation was coated onto the solid ink layer in an amount of 2.7 g/m$^2$ (dry basis) and dried to form a layer of the discoloring agent.

| Leuco-compound-containing composition | |
|---|---|
| Crystal violet lactone | 10 parts |
| Finely divided silica (oil absorbing capacity 145 ml/100 g) | 1 part |
| Vinyl chloride/vinyl acetate copolymer | 2 parts |
| Methyl ethyl ketone | 100 parts |

The leuco-compound-containing composition was ground by means of a ball mill for 24 hours. The resulting composition was then coated over the layer of the discoloring agent in an amount of 2.7 g/m$^2$ (dry basis) and dried to form an upper layer, whereby obtaining a transferring sheet of the present invention having the construction shown in FIG. 3.

| Developer-containing composition | |
|---|---|
| n-Butyl 4-hydroxybenzoate | 20 parts |
| 4-Methoxyphenyl benzoate | 15 parts |
| Finely divided silica (oil absorbing capacity: 200 ml/100 g) | 10 parts |
| Polyvinyl alcohol | 4 parts |
| Water | 100 parts |

The developer-containing composition was ground by means of a ball mill for 24 hours. The resultant composition was coated by means of a wire bar onto a fine quality paper (basis weight 35 g/m$^2$) and dried to form 5 g/m$^2$ of a developing layer over the paper whereby obtaining a receiving sheet of the present invention.

The thus obtained transferring and developing sheets were stacked with the upper, leuco-compound-containing layer being in direct contact with the developing layer and heated from the backside surface of the transferring sheet by means of a thermal head. At a recording temperature of 68° C., there was formed a clear blue pattern. Subsequent recording at 100° C. gave clear black pattern. Both of the blue and black patterns were distinct from each other. The thick and thin lines of each of the blue and black patterns were well defined and free of blurs.

COMPARATIVE EXAMPLE 1

Example 1 was repeated in the same manner as described except that a coating of the discoloring agent-containing composition was not provided, thereby obtaining a transferring sheet carrying no discoloring agent. With the use of this transferring sheet in place of that of Example 1, thermal recording was conducted in the same manner as described in Example 1. A clear blue pattern was obtained by the recording at 68° C. However, the pattern obtained at a recording temperature of 100° C. had a mixed color of blue and black. The thick line of the pattern was blue black at its center portion but was blue at its marginal portion.

EXAMPLES 2–4

Three types of transferring sheet were prepared in the same manner as Example 1 except that the addition product of Bisphenol A was replaced by polyethylene glycol (Example 2), polyoxyethylene cetyl ether (Example 3) and polyethylene glycol monostearate (Example 4). Using respective transferring sheets, thermal recording was performed in the same manner as Example 1, thereby to reveal that clear, distinct colored patterns similar to those in Example 1 were obtained with each transferring sheet.

EXAMPLE 6

| Composition for Lower Layer | |
|---|---|
| Rose Bengal | 18 parts |
| Carbauna wax | 10 parts |
| Paraffin wax (m.p. 97° C.) | 20 parts |
| Ethylene/vinyl acetate copolymer | 3 parts |
| Polyethylene glycol | 30 parts |
| Toluene | 419 parts |

The composition having the above formulation was heated for dissolution and was comingled for 10 hours by means of a ball mill to obtain an ink. The ink was then coated onto a condenser paper (basis weight 15 g/m$^2$) by means of a wire bar and dried to form 4.2 g/m$^2$ of a coating of the lower layer. The leuco-compound-containing composition as used in Example 1 was then coated over the surface of the lower layer in an amount of 1.8 g/m$^2$ (dry basis) to obtain a transferring sheet having the construction shown in FIG. 1.

Using the thus obtained transferring sheet, thermal recording was carried out in the same manner as that in Example 1. Clear and distinct patterns with red and blue colors were obtained likewise in Example 1.

EXAMPLE 6

| Solid ink composition | |
|---|---|
| Rose Bengal | 18 parts |
| Carbauna wax | 10 parts |
| Polyethylene wax (m.p. 104° C.) | 20 parts |
| Ethylene/vinyl acetate copolymer | 3 parts |
| Vaseline | 5 parts |
| Kaoline | 5 parts |

The composition having the above formulation was kneaded at 110° C. for 2 hours by means of a kneader with three rolls to obtain a fused ink. The ink was then coated onto a condenser paper (basis weight 15 g/m$^2$) by way of a hot-melt coating method and allowed to be cooled to form 2.7 g/m$^2$ of a coating of the solid ink.

| Discoloring agent-containing composition | |
|---|---|
| Polyethylene glycol | 20 parts |
| Polyvinyl alcohol (15% aqueous solution) | 20 parts |
| Water | 60 parts |

The discoloring agent-containing composition with the above formulation was coated onto the solid ink layer in an amount of 3 g/m$^2$ (dry basis) and dried to form a layer of the discoloring agent.

| Composition for Protecting Layer | |
|---|---|
| Styrene/vinyltoluene copolymer (m.p. 100° C.) | 30 parts |
| Cyclohexane | 60 parts |

The above composition was coated over the surface of the discoloring agent-containing layer to form thereon 2.5 g/m$^2$ of the protecting layer.

| Leuco-compound-containing composition | |
|---|---|
| 3-N—methyl-N—cyclohexylamino-6-methyl-7-anilinofluorane | 10 parts |
| Finely divided silica (oil absorbing capacity 145 ml/100 g) | 1 part |
| Vinyl chloride/vinyl acetate copolymer | 2 parts |
| Methyl ethyl ketone | 100 parts |

The leuco-compound-containing composition was ground by means of a ball mill for 24 hours. The resulting composition was then coated over the protecting layer in an amount of 1.5 g/m$^2$ (dry basis) and dried to form an upper layer, whereby obtaining a transferring sheet of the present invention having the construction shown in FIG. 5.

The thus obtained transferring sheet and the developing sheet as used in Example 1 were stacked with the upper, leuco-compound-containing layer being in direct contact with the developing layer and heated from the backside surface of the transferring sheet by means of a thermal head. At a recording temperature of 68° C., there was formed a clear black pattern. Subsequent recording at 110° C. gave clear red pattern. Both of the black and red patterns were distinct from each other. The thick and thin lines of each of the blue and black patterns were well defined and free of blurs.

The transferring sheet obtained in this Example was allowed to stand at 60° C., 80% RH for 24 hours. Thereafter, it was subjected to thermal recording tests conducted in the same manner as that of Example 1. The transferring sheet gave the same distinct colored image as before. Further, it was found that the transferring sheet of this Example had superior stability to storage (preservability) in comparison with that of Example 1.

EXAMPLES 7 and 8

Two types of transferring sheet were prepared in the same manner as described in Example 6 except that the styrene copolymer used as the protecting layer was substituted with polyethylene wax (m.p. 90° C.) (Example 7) and a polyamide resin (m.p. 105° C.) (Example 8). Each transferring sheet was found to give clear colored image and to have good preservability similar to that of Example 6.

EXAMPLE 9

Example 5 was repeated in the same manner as described except that the composition for the protecting layer used in Example 6 was coated over the surface of the lower layer in an amount of 2.5 g/m$^2$ (dry basis) prior to the formation of the upper, leuco-compound-containing layer, thereby to obtain a transferring sheet having the construction shown in FIG. 4. Thermal recording test and the preservability test were conducted in the same manner as described in Example 6 to reveal that the transferring sheet of this Example exhibited good results.

The invention may be embodied in other specific forms without departing from the spirit or essential characteristics thereof. The present embodiments are therefore to be considered in all respects as illustrative and not restrictive, the scope of the invention being indicated in the appended claims rather than by the foregoing description, and all the changes which come within the meaning and range of equivalency of the claims are therefore intended to be embraced therein.

We claim:

1. A heat-sensitive recording medium comprising:
(a) a transferring sheet which includes
a first substrate,
a lower layer provided over said first substrate and comprised of a discoloring agent and a solid ink having a first color, and
an upper layer provided above said lower layer and containing a leuco-compound capable of coloring in a second color which is different from said first color by reaction with a developer at such a first temperature that at least one of said leuco-compound and said developer can melt but that neither said discoloring agent nor said solid ink can melt, said leuco-compound being incapable of coloring upon contact with said developer in the presence of said discoloring agent at such a second temperature that both of said discoloring agent and said solid ink can melt; and
(b) a receiving sheet which includes
a second substrate, and
a developing layer provided over said second substrate and containing said developer,
whereby, when said recording medium is subjected to thermal recording temperatures with said upper layer being maintained in thermal contact with said developing layer, there are formed a first image developed by the contact between said leuco-compound and said developer at said first temperature and a second, fused image of said solid ink at said second temperature, said first and second images being received by said receiving sheet.

2. A heat-sensitive recording medium as claimed in claim 1, wherein said lower layer is a layer of said solid ink having said discoloring agent substantially homogeneously dispersed therein.

3. A heat-sensitive recording medium as claimed in claim 1, wherein said lower layer is a composite layer composed of a first layer of said solid ink provided over said first substrate and overlaid with a second layer of said discoloring agent.

4. A heat-sensitive recording medium as claimed in claim 1, further comprising a protecting layer provided between said upper and lower layers and capable of melting at a temperature not higher than said second temperature.

5. A heat-sensitive recording medium as claimed in claim 1, wherein said second temperature is higher than said first temperature at least by 20° C.

6. A heat-sensitive recording medium as claimed in claim 5, wherein said first and second temperatures are in the range of between 60° and 100° C. and between 85° and 150° C., respectively.

7. A heat-sensitive recording medium as claimed in claim 1, wherein said solid ink has a melting point in the range of between 85° and 150° C.

8. A heat-sensitive recording medium as claimed in claim 1, wherein said solid ink is provided in an amount of between 1 and 10 g per one square meter of said first substrate.

9. A heat-sensitive recording medium as claimed in claim 1, wherein said discoloring agent is used in an amount of between 0.5 and 5 parts by weight per part by weight of said leuco-compound.

10. A heat-sensitive recording medium as claimed in claim 1, wherein said developer has a melting point of 200° C. or less.

11. A heat-sensitive recording medium as claim in claim 1, wherein said developer is used in an amount of between 2 and 15 parts by weight per part by weight of said leuco-compound.

12. A heat-sensitive recording medium as claimed in claim 1, wherein each of said upper layer and said developing layer further contains a binder.

13. A heat-sensitive recording medium as claimed in claim 1, wherein at least one of said upper layer and said developing layer contains a finely divided porous filler having an oil absorbing capacity of at least 50 ml/100 g.

14. A heat-sensitive recording medium as claimed in claim 13, wherein said filler is contained in said developing layer in an amount of between 0.05 and 10 parts by weight per part by weight of said developer.

15. A heat-sensitive recording medium as claimed in claim 13, wherein said filler is contained in said upper layer in an amount of between 0.01 and 1 part by weight per part by weight of said leuco-compound.

16. A heat-sensitive recording medium as claimed in claim 1, wherein at least one of said upper layer and said developing layer further contains a fusible material capable of melting at a temperature not higher than said first temperature and of lowering the melting temperature or temperatures of said leuco-compound and/or said developer.

* * * * *